United States Patent [19]

Denter et al.

[11] Patent Number: 4,762,042

[45] Date of Patent: Aug. 9, 1988

[54] REFILLABLE DISPENSER FOR ROLLS OF PAPER OR FOIL

[75] Inventors: Ulrich Denter, Hambach; Dieter Himmighofen, Roth; Rolf G. Schülein, Singhofen, all of Fed. Rep. of Germany

[73] Assignee: Leifheit AG, Nassau, Fed. Rep. of Germany

[21] Appl. No.: 116,007

[22] Filed: Oct. 30, 1987

[30] Foreign Application Priority Data

Oct. 31, 1986 [EP] European Pat. Off. ..... 86115138.9

[51] Int. Cl.[4] ..... B65D 85/671

[52] U.S. Cl. ..... 83/374; 83/455; 83/485; 83/582; 83/650

[58] Field of Search ..... 83/374, 455, 485, 582, 83/649, 650

[56] References Cited

U.S. PATENT DOCUMENTS

| | | | |
|---|---|---|---|
| 3,142,217 | 7/1964 | Busse | 83/455 |
| 3,222,972 | 12/1965 | Fulton | 83/649 X |
| 3,236,427 | 2/1966 | Martin | 83/649 X |
| 3,240,093 | 3/1966 | Bell, Jr. et al. | 83/649 X |

FOREIGN PATENT DOCUMENTS

| | | |
|---|---|---|
| 1946081 | 4/1971 | Fed. Rep. of Germany . |
| 2849457 | 5/1980 | Fed. Rep. of Germany . |
| 2036694 | 1/1983 | United Kingdom . |

*Primary Examiner*—Frank T. Yost

*Attorney, Agent, or Firm*—Frishauf, Holtz, Goodman & Woodward

[57] ABSTRACT

A refillable dispenser for web materials has a housing 1 and a snap-fitted cover 2. A slidable cutter 3 rides in a slit 25 of cover 2. A vertical cutting support surface 11 is formed as an integral extension of a horizontal roll support plate 9. Baseplates 9 may also be integrally formed with back wall 8 of housing 1. The junction of plate 9 and cutting surface 11 define with the adjacent edge of cover 2 a dispensing slot 14, so replacement of rolls 17 is facilitated and threading of web material is simplified. A cooperating lip 18 and recess 19 on surface 11 facilitate grasping the end of the web, and a labyrinthine web path 20 defined by ribs 15, 16 prevents retraction of web material, particularly clingly plastic wrap, back onto the roll after cutting. A leaf spring 29 inside cover 2 urges a disk-shaped blade 23 into a slot 24 of surface 11 while a housing surrounding the blade protects the user.

7 Claims, 3 Drawing Sheets

REFILLABLE DISPENSER FOR ROLLS OF PAPER OR FOIL

CROSS-REFERENCE TO RELATED PATENT DOCUMENTS

German published examined application DE-AS No. 19 46 081, Walker, filed Sept. 11, 1969, laid open Apr. 1, 1971; U.K. Pat. No. 2,036,694, Liebscher, Schulein & Himmighofen, issued Jan. 6, 1983, claiming priority from Fed. Rep. Germany application P 2A 49 457, filed Nov. 15, 1978, laid open May 22, 1980.

The present invention relates generally to refillable dispensers for rolls or webs of material, and more particularly to an improved dispenser in which a cutting support surface is formed as an integral extension of a roll support baseplate, and the extension and the dispenser cover together define the dispensing slit.

BACKGROUND

Refillable dispensers with a cutting edge are well known. They are used in homes, offices and workshops to keep paper or foil ready for the required purposes and to cut it off in ready-to-use lengths.

DE-AS No. 19 46 081, Walker, discloses a medical dispenser for web material, with a separating device. The separating device comprises a transversely slidable cutter mounted on a cover cowling. This structure is very costly. Grasping the web for pulling more material off the roll is very difficult, and requires practically lifting up the cover. Furthermore, it does not satisfy the aesthetic requirements of the modern kitchen.

U.K. Pat. No. 2,036,694, Liebscher, Schulein & Himmighofen, (the latter two being co-inventors of the present application) discloses a refillable kitchen dispenser for paper and foil. In this structure, there are provided receptacles for multiple rolls, which can be separated by a transversely slidable cutter. This device also has the disadvantage that only a short segment or end of the roll is left projecting for the user to grasp. It often happens that the roll completely retracts into the receptacle. The device also has the disadvantage of being refillable only from one side, i.e. refilling requires removing it from the wall. From an aesthetic point of view, the device is also no longer satisfactory because of its fissured appearance.

THE INVENTION

Accordingly, among the objects of the present invention are to provide a refillable dispenser for paper and foil rolls, particularly for household use, which satisfies the aesthetic requirements of the modern kitchen, which is easy to service, which facilitates subsequent gripping of the end of the roll, and which imposes minimal manufacture and assembly requirements.

Briefly, this is accomplished by making the cutting support surface an integral extension of the roll support baseplate. A smooth front for the dispenser is achieved by the L-shaped cutting support surface, which exactly penetrates the cover. The possibility of disposing the cutter well below the dispensing slit permits leaving a long end piece of the roll extending from the dispenser for gripping.

A number of other features are also advantageous. Retraction of the end of the roll into the dispenser is reliably prevented by means of a labyrinthine web path. The cover and its connected cutters are very easy to take off the front, so that replacement of rolls is problem-free. Connecting the cutting support surfaces to the opening in the cover obviates difficult threading-in of the web. For reliable grasping of clingy clear plastic wraps, there are provided a transversely extending grip lip and a grip recess. The grip lip projects perpendicularly to the cutting support surface and results in a lifting up of the projecting end of the plastic web. The dispenser is therefore particularly user-friendly.

DRAWINGS

These and other advantages of the present invention will be apparent from the drawings, in which.

DETAILED DESCRIPTION

Figure 1:
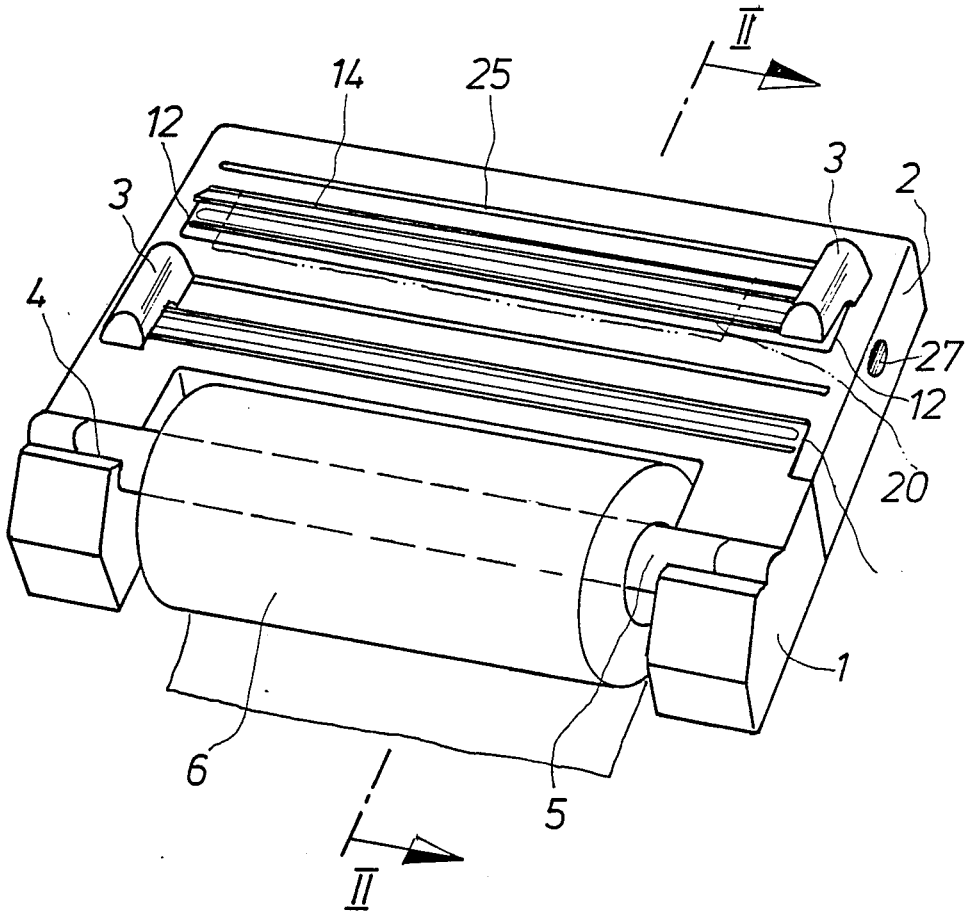
FIG. 1 is a perspective view of the dispenser.

The dispenser comprises a housing 1, a cover 2 with sliding cutters 3, a pair of axle mounts 4 supporting an axle 5, for receiving a paper towel roll 6.

Housing 1 forms two storage chambers 7 defined by a back wall 8 and two baseplates 9 projecting therefrom. Two holding members 10, for receiving axle 5, project downwardly on respective sides of housing 1.

Figure 2:
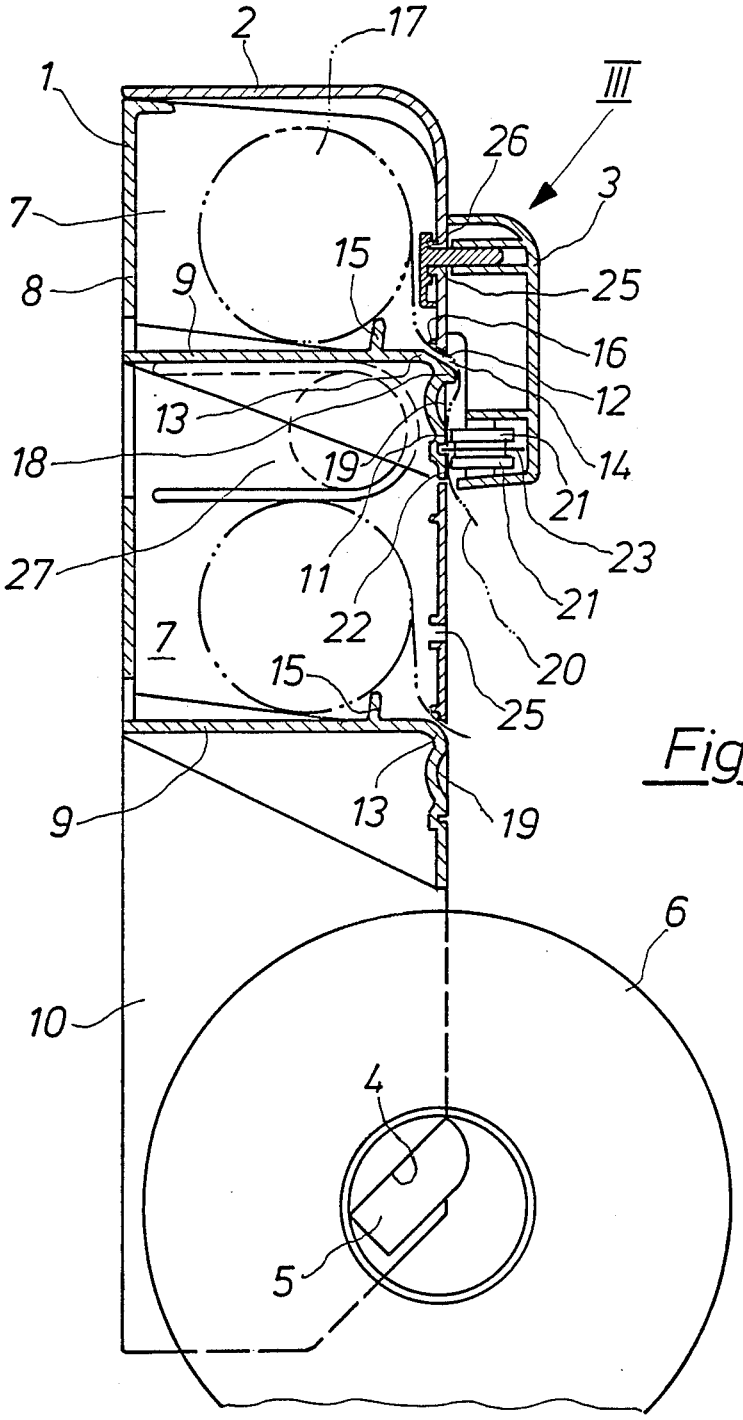
FIG. 2 is a cross-section along line II—II of FIG. 1.

At the front of baseplates 9 are formed orthognoal extensions 11 which serve as cutting support surfaces. These cutting support surfaces 11 extend through openings 12 in cover 2. As shown in FIG. 2, each upper rim 13 of the respective cutting support surface and the adjacent edge of cover 2 together define a dispensing slit 14 for the web. Slit 14 appears enlarged in FIG. 3.

Figure 3:
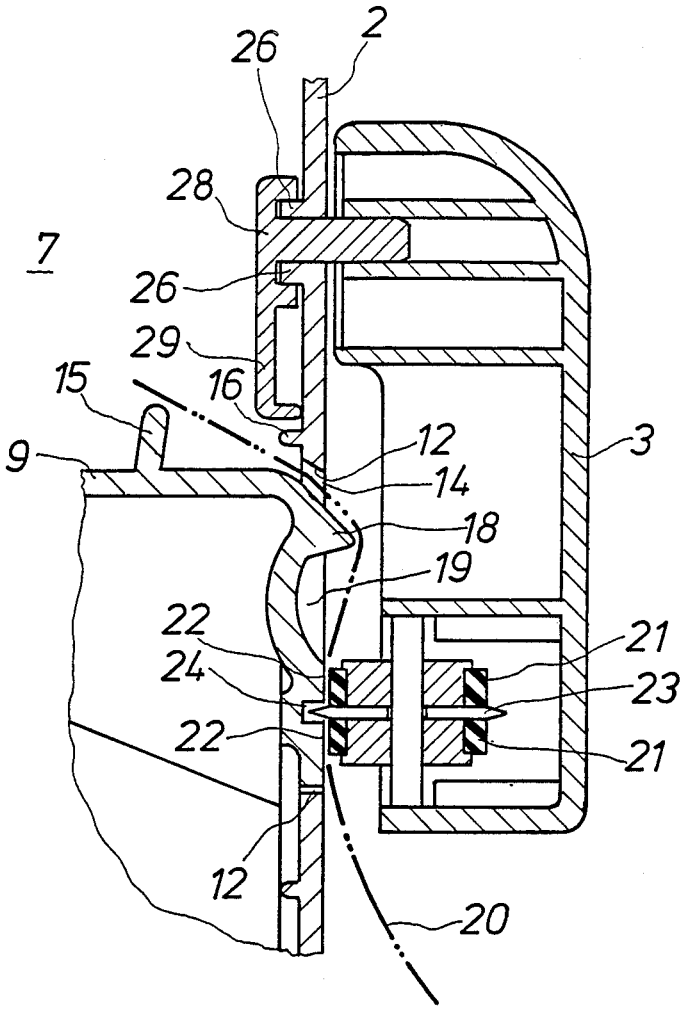
FIG. 3 is an enlarged, partially broken-away view of portion III of FIG. 2, in which the web path is indicated by the chain-dotted line.

A transversely projecting rib 15 is formed on the upper surface of each baseplate 9. As shown in FIG. 3, a horizontally extending rib 16 on the inner surface of cover 2 cooperates with rib 15 to form a labyrinth for web passage. Transverse rib 15 also serves as a stop for roll 17.

Each cutting support surface 11 is formed with a transversely extending, projecting grip lip 18 and a transversely extending grip recess 19 below lip 18. The path of the end of the web or roll is indicated by line 20. As shown in FIG. 3, below horizontal recess 18, baseplate extensions 11 are formed with a pair of parallel, horizontal, preferably flat running surfaces 22 separated by a blade-receiving slot 24. A slidable cutter assembly 3 is supported from cover 2 in front of each extension 11 and has a blade 23 which travels along slot 24 during cutting operations. Blade 23 is preferably disk-shaped and is mounted on a vertical axis between a pair of pressure wheels or rollers 21 which ride along the pair of running surfaces 22 and thereby tension the web as it is being severed by blade 23.

As indicated in FIG. 1, cover 2 is formed with respective horizontal guide slits 25 for receiving respective slidable cutters 3. At each edge of each slit 25, cover 2 has an inwardly projecting rail 26 which gives it an L-shaped cross section. Cover 2 is box-shaped and is snap-fitted over detents on each side of housing 1.

A generally cross-sectionally key- or fork-shaped member 28 has a central tine which extends through slit 25 and supports slidable cutter 3. The central tine is flanked by a pair of shorter tines which engage around rails 26 on the inside of cover 2. As shown in FIG. 3, a downward extension 29 of member 28 rides along the inner surface of cover 2 and acts as a cantilevered leaf spring 29 to rotate cutter 3 downward and thereby press blade 23 into blade-receiving slot 24.

Those skilled in the art will appreciate that various changes and modifications are possible within the scope of the inventive concept. Accordingly, the invention is not restricted to the single embodiment shown and described, but rather is defined by the appended claims.

We claim:

1. Refillable dispenser for rolls of web material (6, 17) having:

a housing (1) receiving at least one roll;

a cover (2) supported by the housing (1);

a cutter (3) tranversely slidable along the cover (2), and a cutting support surface (11) formed on the housing (1);

wherein, in accordance with the invention;

said housing includes a back wall (8) and a baseplate (9) projecting therefrom;

said cutting support surface (11) is formed as an extension of said baseplate (9); and said cutting support surface extends through an opening (12) formed in said cover (2) and, together with said cover, defines a dispensing slit (14) for said web material.

2. Refillable dispenser according to claim 1, wherein: a transverse rib (15) is formed on said baseplate (9) behind said cover (2) and, together with said cover (2) and said dispensing slit (14), defines a labyrinthine web path (20).

3. Refillable dispenser according to claim 1, wherein: said cover is generally box-shaped and secures to said housing by means of snap-fit detents (27).

4. Refillable dispenser according to claim 1, wherein: said housing (1) has a depending projection (10) on each side which are formed with mounts (4) for an axle (5) for a roll (6) of web material.

5. Refillable dispenser according to claim 1, wherein: said cover is formed with cross-sectionally L-shaped portions (26) which define a guide slit (25) for said slidable cutter (3).

6. Refillable dispenser according to claim 1, wherein: said cutting support surface is formed with a transversely extending grip recess (19) and a transversely extending cutting slot (24) disposed below said recess.

7. Refillable dispenser according to claim 1, wherein: said cutting support surface is formed with a transversely extending grip lip (18).

* * * * *